US006152152A

United States Patent [19]

Reynen et al.

[11] Patent Number: 6,152,152

[45] Date of Patent: Nov. 28, 2000

[54] ANTIBACTERIAL LIQUID DISHWASHING DETERGENT COMPOSITIONS

[75] Inventors: Michael Jakob Reynen, Grimbergen, Belgium; Nikipad Aryana, Paris, France

[73] Assignee: The Procter & Gamble Company, Cincinnati, Ohio

[21] Appl. No.: 09/355,080

[22] PCT Filed: Jan. 14, 1998

[86] PCT No.: PCT/US98/00695

§ 371 Date: Sep. 1, 1999

§ 102(e) Date: Sep. 1, 1999

[87] PCT Pub. No.: WO98/32821

PCT Pub. Date: Jul. 30, 1998

[30] Foreign Application Priority Data

| | | | |
|---|---|---|---|
| Jan. 24, 1997 | [EP] | European Pat. Off. | 97870006 |
| Aug. 14, 1997 | [EP] | European Pat. Off. | 97870119 |

[51] Int. Cl.[7] ..... B08B 3/04; C11D 3/20; C11D 3/34; C11D 3/50

[52] U.S. Cl. ..... 134/25.2; 510/101; 510/235; 510/421; 510/426; 510/432; 510/505; 510/492

[58] Field of Search ..... 510/101, 235, 510/421, 426, 432, 505, 492; 134/25.2

[56] References Cited

U.S. PATENT DOCUMENTS

| | | | |
|---|---|---|---|
| 4,767,563 | 8/1988 | De Buzzaccarini | 510/397 |
| 5,281,354 | 1/1994 | Faber | 510/397 |
| 5,538,664 | 7/1996 | Michael | 510/217 |

*Primary Examiner*—Gregory R. DelCotto
*Attorney, Agent, or Firm*—Ian S. Robinson; Kim William Zerby; Steven W. Miller

[57] ABSTRACT

Dishwashing compositions which comprise a surfactant, a hydrotrope and an unsaturated terpene alcohol or derivative exhibit antimicrobial properties. They are used to cleanse dishware while disinfecting dishware-cleaning implements such as sponges and absorbent cloths.

5 Claims, No Drawings

ANTIBACTERIAL LIQUID DISHWASHING DETERGENT COMPOSITIONS

TECHNICAL FIELD

The invention relates to liquid dishwashing detergent compositions. The compositions have antibacterial properties.

BACKGROUND

Liquid dishwashing compositions are much desired by consumers and can be used neat or diluted. In diluted mode, a composition is diluted in water to form a wash liquor in which the dishes to be cleaned are immersed. In neat mode, a composition is directly applied neat onto dishes, and in this mode a dish implement is often use. Specifically, the composition is applied onto the implement, usually a sponge or a dishcloth, which is in turn contacted with the dishes to be cleaned.

A problem arises that dish implements are left humid most of the time, and so they provide a good medium for bacterial growth. The contaminated implement which is used to clean dishes will in turn contaminate those dishes.

We have now found that certain dishwashing compositions can fulfill the further purpose of reducing or eliminating bacterial growth on dish implements.

SUMMARY OF THE INVENTION

The compositions of the present invention are liquid dishwashing compositions comprising:

a surfactant, a hydrotrope selected from the group consisting of salts of cumene sulfonate, toluene sulfonate, xylene sulfonate, benzene sulfonate or mixtures thereof; and an unsaturated aliphatic terpene alcohol or derivative.

The invention further encompasses a method of washing dishes with these compositions. Without wishing to be bound by theory, it is believed that the anti bacterial efficacy of said formulations is mainly driven by a synergy between the hydrotrope(s) and the unsaturated aliphatic terpene alcohol(s) or derivative.

DETAILED DESCRIPTION OF THE INVENTION

The compositions of the invention are aqueous liquid compositions. They typically comprise from 30% to 90% by weight of the total composition of water, preferably 40% to 85%.

The compositions herein are liquid and so they typically have a viscosity of from 5 cps to 2000 cps, preferably 5 cps to 400 cps, most preferably 5 cps to 350 cops, measured with a Brookfield Viscometer, with a No. 18 spindle, at 20° C.

Surfactants

The compositions of the present invention comprise, as an essential ingredient, one or several of the following surfactants. Suitable for use herein are amine oxides according to the formula:

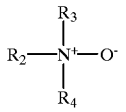

wherein $R_2$ represents a straight or branched alkyl or alkenyl group having 10 to 16 carbon atoms, and $R_3$ and $R_4$ represent a $C_1$ to $C_4$ hydrocarbon chain, preferably a methyl group or an ethyl group. Generally, when the number of carbon atoms in $R_2$ is less than 10, the detergency of the composition is lowered, while if it exceeds 16, the stability of the composition at low temperatures deteriorates.

Also suitable for use herein are alkyl alkoxylated sulfates of the formula $R_1O(A)_nSO_3M$, wherein $R_1$ is an alkyl or alkenyl group having 9 to 15 carbon atoms, A is an alkoxy group, preferably ethoxy or propoxy, most preferably ethoxy, n represents 0.5 to 7 of real number in average, and M is an alkalimetal, alkali earth metal, ammonium or alkanolammonium group.

The use of alkyl alkoxylated sulfates with lower values for n, on an equal weight basis, typically when n is below 1.0, improves the performance of the composition on grease removal and sudsing due to the corresponding increase in moles of anionic but results in an increase in the total amount of unalkoxylated alkyl sulphate, and this seems to make the low temperature instability issue more acute. If different alkyl alkoxylated sulfates are used which have different n values, the resulting average n value of the alkyl alkoxylated sulfate in the composition will be the weighted molar average n value of the individual n values of the different alkyl alkoxylated sulfates used in the composition.

If the average n value is less than 0.5, the stimulus to skin increases and this is not desirable. On the other hand, if the average n value is more than 3, the detergency deteriorates.

Concerning $R_1$, if the average number of carbon atoms in $R_1$ is less than 9, the detergency is insufficient, while if it is more than 16, the stability at low temperature deteriorates.

Suitable alkyl alkoxylated material for use herein can be straight or branched materials. By branched material, it is meant that $R_1$ is branched, while the position of the branching, and the length of the branched group is as determined by the position of the CH2—OH functional group in the parent alcohol. The increase in the proportion of branched material can improve the physical stability of the composition at low temperature.

In this respect, it is important that the branched alkyl alkoxylated sulfate material should not represent more than 60%, by weight, of the total alkyl alkoxylated sulfate (branched plus linear), otherwise the sudsing performance of the product deteriorates unacceptably. At the other end of the range, there should be enough branched alkyl alkoxylated sulfate to achieve a suitable low temperature stability. This minimum value depends on the specific needs, and can be evaluated by plotting the stability of a given matrix at the desired temperature, as a function of the proportion of branched material. Generally, branched alkyl alkoxylated sulfates should be present in amounts of up to 60%, preferably from 10% to 55%, most preferably 10% to 50%.

Alkyl alkoxylated sulfates are commercially available with a variety of chain lengths, degrees of alkoxylation and degrees of branching under the trade names Empicol® ESA 70 (AE1S) or Empicol® ESB 70 (AE2S) by Albright & Wilson, with C12/14 carbon chain length distribution which are derived from natural alcohols and are 100% linear, Empimin® KSL68/A—AE1S and Empimin® KSN70/LA—AE3S by Albright & Wilson with C12/13 chain length distribution and about 60% branching, Dobanol® 23 ethoxylated sulphates from Shell with C12/13 chain length distribution and about 18% branching, Lial® 123 ethoxylated sulphates from Condea Augusta with C12/13 chain length distribution and about 60% branching and Isalchem® 123 alkoxylated sulphates with C12/13 chain length distribution and about 95% branching.

Also, suitable alkyl alkoxylated sulfates can be prepared by alkoxylating and sulfating the appropriate alcohols, as described in "Surfactants in Consumer Products" by J.Falbe and "Fatty oxo-alcohols: Relation between their alkyl chain structure and the performance of the derived AE,AS,AES" submitted to the 4th World Surfactants, Barcelona, 3–7 VI 1996 Congress by Condea Augusta. Commercial oxo-alcohols are a mixture of primary alcohols containing several isomers and homologues. Industrial processes allow one to separate these isomers hence resulting in alcohols with linear isomer content ranging from 5–10% to upto 95%. Examples of available alcohols for alkoxylation and sulfation are Lial® alcohols by Condea Augusta (60% branched), Isalchem® alcohols by Condea Augusta (95% branched), Dobanol® alcohols by Shell (18% linear).

Other suitable surfactants for use herein are:

Alkyl benzene sulfonates in which the alkyl group contains from 9 to 15 carbon atoms, preferably 11 to 40 carbon atoms in straight chain or branched chain configuration. An especially preferred linear alkyl benzene sulfonate contains about 12 carbon atoms. U.S. Pat. Nos. 2,220,099 and 2,477,383 describe these surfactants in detail.

Alkyl sulfates obtained by sulfating an alcohol having 8 to 22 carbon atoms, preferably 12 to 16 carbon atoms. The alkyl sulfates have the formula $ROSO_3$—$M^+$where R is the $C_{8-22}$ alkyl group and M is a mono- and/or divalent cation.

Paraffin sulfonates having 8 to 22 carbon atoms, preferably 12 to 16 carbon atoms, in the alkyl moiety. These surfactants are commercially available as Hostapur SAS from Hoechst Celanese.

Olefin sufonates having 8 to 22 carbon atoms, preferably 12 to 16 carbon atoms. U.S. Pat. No. 3,332,880 contains a description of suitable olefin sulfonates.

Alkyl glyceryl ether sulfonates having 8 to 22 carbon atoms, preferably 12 to 16 carbon atoms, in the alkyl moiety.

Fatty acid ester sulfonates of the formula:

$$R_1—CH(SO_3^-M^+)CO_2R_2$$

wherein $R_1$ is straight or branched alkyl from about $C_8$ to $C_{18}$, preferably $C_{12}$ to $C_{16}$, and $R_2$ is straight or branched alkyl from about $C_1$ to $C_6$, preferably primarily $C_1$, and $M^+$represents a mono- or divalent cation.

Secondary alcohol sulfates having 6 to 18, preferably 8 to 16 carbon atoms.

Other suitable co-surfactants herein are

Fatty acid amide surfactants having the formula:

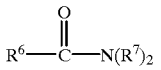

wherein $R^6$ is an alkyl group containing from 7 to 21, preferably from 9 to 17, carbon atoms and each $R^7$ is selected from the group consisting of hydrogen, $C_1$–$C_4$ alkyl, $C_1$–$C_4$ hydroxyalkyl, and —$(C_2H_4O)_xH$ where x varies from 1 to about 3.

Polyhydroxy fatty acid amide surfactant of the structural formula:

(I)

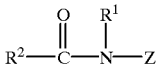

wherein $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_1$g alkyl or alkenyl, more preferably straight chain $C_9$–$C_{17}$ alkyl or alkenyl, most preferably straight chain $C_{11}$–$C_{17}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. Z preferably will be selected from the group consisting of —$CH_2$—$(CHOH)_n$—$CH_2OH$, —$CH(CH_2OH)$—$(CHOH)_{n-1}$—$CH_2OH$, —$CH_2$—$(CHOH)_2(CHOR')(CHOH)$—$CH_2OH$, where n is an integer from 3 to 5, inclusive, and R' is H or a cyclic or aliphatic monosaccharide, and alkoxylated derivatives thereof. Most preferred are glycityls wherein n is 4, particularly —$CH_2$—$(CHOH)_4$—$CH_2OH$.

In formula (I), $R^1$ can be, for example, N-methyl, N-ethyl, N-propyl, N-isopropyl, N-butyl, N-2-hydroxy ethyl, or N-2-hydroxy propyl.

$R^2$—CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Betaine detergent surfactants having the general formula:

$$R—N^{(+)}(R^1)_2—R^2COO(-)$$

wherein R is a hydrophobic group selected from the group consisting of alkyl groups containing from 10 to 22 carbon atoms, preferably from 12 to 18 carbon atoms, alkyl aryl and aryl alkyl groups containing a similar number of carbon atoms with a benzene ring being treated as equivalent to about 2 carbon atoms, and similar structures interrupted by amide or ether linkages; each $R^1$ is an alkyl group containing from 1 to about 3 carbon atoms; and $R^2$ is an alkylene group containing from 1 to about 6 carbon atoms.

Ethylene oxide condensates, which can be broadly defined as compounds produced by the condensation of ethylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired balance between hydrophilic and hydrophobic elements.

Examples of such ethylene oxide condensates suitable as suds stabilizers are the condensation products of aliphatic alcohols with ethylene oxide. The alkyl chain of the aliphatic alcohol can either be straight or branched and generally contains from about 8 to about 18, preferably from about 8 to about 14, carbon atoms for best performance as suds stabilizers, the ethylene oxide being present in amounts of from about 8 moles to about 30, preferably from about 8 to about 14 moles of ethylene oxide per mole of alcohol.

Cationic quaternary ammonium surfactants of the formula;

$$[R^1(OR^2)_y][R^3(OR^2)_y]_2R^4N^{30}\ X^-$$

or amine surfactants of the formula:

$$[R_1(OR^2)_y][R^3(OR^2)_y]R^4N$$

wherein $R_1$ is an alkyl or alkyl benzyl group having from about 6 to about 16 carbon atoms in the alkyl chain; each $R^2$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^3$ is selected from the group consisting Of $C_1$–$C_4$ alkyl, $C_1$–$C_4$ hydroxyalkyl, benzyl, and hydrogen when y is not 0; $R^4$ is the same as $R^3$ or is an alkyl chain wherein the total number of carbon atoms of $R_1$ plus $R^4$ is from about 8 to about 16, each y is from about 0 to about 10, and the sum of the y values is from about 0 to about 15; and X is any compatible anion.

The compositions herein typically comprise from 10% to 60% by weight of the total composition of a surfactant, or mixtures thereof, preferably from 10% to 55%, most preferably from 10% to 50%.

Hydrotropes

As a second essential ingredient, the compositions herein comprise a hydrotrope selected from the group consisting of salts of cumene sulfonate, toluene sulfonate, xylene sulfonate, benzene sulfonate or mixtures thereof. Preferred salts are ammonium and sodium salts.

The compositions herein typically comprise from 1% to 15% by weight of the total composition of said hydrotropes, preferably 1% to 10%, most preferably 2% to 6%.

Unsaturated Aliphatic Terpene Alcohol or Derivative

As a third essential ingredient, the compositions herein comprise an unsaturated aliphatic terpene alcohol or derivates thereof (i.e unsaturated aliphatic terpene alcohols where the alcohol group is functionalized, e.g. into acetate, formate, propionate, or the like) or mixtures thereof. Suitable such alcohols or derivatives for use herein include geraniol, nerol, citronellol, linalool, citronellyc acetate, geranyl acetate, linalyl acetate, citronellyl formate, geranyl formate, linalyl formate, citronellyl propionate, geranyl propionate and linalyl propionate.

Most preferred for use herein is geraniol.

The compositions herein typically comprise from 0.1% to 3% by weight of the total composition of said unsaturated aliphatic terpene alcohol, preferably 0.2% to 2.5%, most preferably 0.4% to 2%.

Optionals

The compositions herein can comprise a number of other, optional ingredients, as follows:

A first optional, but preferred ingredient is a phenolic compound according to the formula

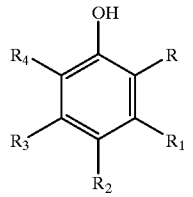

wherein R, R1 , R2, R3, R4 are independently H, a linear or branched, saturated or unsaturated hydrocarbon chain having from 1 to 20 carbon atoms, preferably from 1 to 10, more preferably from 1 to 4, an alkoxylated hydrocarbon chain according to the formula $Ra(A)_n$ wherein Ra is a linear or branched, saturated or unsaturated hydrocarbon chain having from 1 to 20 carbon atoms, preferably from 1 to 10, more preferably from 1 to 4, wherein A is butoxy, propoxy and/or ethoxy, and n is an integer of 1 to 4, preferably from 1 to 3, or an aryl chain having from 1 to 20 carbon atoms, preferably from 1 to 10 and more preferably from 1 to 4, or mixtures thereof. Highly preferred from that class of ingredients are Eugenol and Thymol.

The compositions herein can comprise from 0.1% to 4%, preferably from 0.2% to 1.5% by weight of the total composition of such a phenolic compound or mixtures thereof.

Magnesium Ions:

The compositions herein preferably comprise from 0% to 2.0%, preferably 0.1% to 1.5%, most preferably from 0.2% to 1% by weight of the composition, of magnesium ions which may be added to the liquid detergent compositions of the invention for improved product stability, as well as improved sudsing and skin mildness.

It is preferred that the magnesium ions are introduced by neutalization of the acid form of alkylethoxy surfactants with a magnesium oxide or magnesium hydroxide slurry in water. Normally, this method is limited by the amount of anionic surfactants in the composition. An alternative method is to use MgCl2, MgSO4 or other inorganic Mg salts. These materials are less desirable because they can cause corrosivity problems (chloride salts), decrease the solubility of the formulations, or cause formulatibility/stability problems in the compositions. It is desirable for these reasons to limit the addition of inorganic salts to less than 2%, preferably less than 1 % by weight of the anionic inorganic counterion.

Anti-Gelling Polymer:

As another optional component, the compositions of the invention comprise an anti-gelling polymer which improves the compositions' resistance to gelling. Suitable polymers for use herein have a molecular weight of at least 500, preferably from 500 to 20000, more preferably 1000 to 5000, most preferably 1000 to 3000.

The required amount of anti-gelling polymer can easily be determined by trial and error, but generally, the compositions herein comprise from 0.5% to 6% by weight of the total composition of an anti-gelling polymer, or mixtures thereof, preferably 0.5% to 4%, most preferably 1.5% to 3%.

Suitable polymers for use herein include:

polyalkylene glycols, preferably polyethylene glycol and polypropylene glycol;

polyamines; Particularly suitable polyamine polymer for use herein are alkoxylated or polyalkoxylated polyamines. Such materials can conveniently be represented as molecules of the empirical structures with repeating units:

Amine form

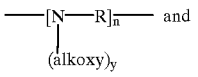

and

Quaternized form

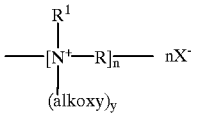

wherein R is a hydrocarbyl group, usually of 2–6 carbon atoms; $R^1$ may be a $C_1$–$C_{20}$ hydrocarbon; the alkoxy groups are ethoxy, propoxy, and the like, and y is 2–30, most preferably from 10–20; n is an integer of at least 2, preferably from 2–20, most preferably 3–5; and $X^-$ is an anion such as halide or methylsulfate, resulting from the quaternization reaction.

The most highly preferred polyamines for use herein are the so-called ethoxylated polyethylene amines, i.e., the polymerized reaction product of ethylene oxide with ethyleneimine, having the general formula:

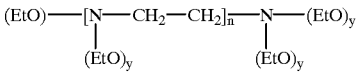

when y=2–30. Particularly preferred for use herein is an ethoxylated polyethylene amine, in particular ethoxylated tetraethylenepentamine, and quaternized ethoxylated hexamethylene diamine.

Terephtalate-based polymers; Suitable terephtalate polymers for use herein include polymers having the formula:

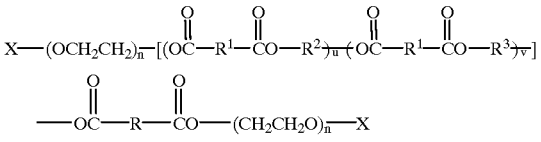

wherein each $R^1$ is a 1,4-phenylene moiety; the $R^2$ are essentially 1,2-propylene moieties; the $R^3$ are essentially the polyoxyethylene moiety $—(CH_2H_2O)_q—CH_2—CH_2—$; each X is ethyl or preferably methyl; each n is from about 12 to about 45; q is from about 12 to about 90; the average value of u is from about 5 to about 20; the average value of v is from about 1 to about 10; the average value of u+v is from about 6 to about 30; the ratio u to v is from about 1 to about 6.

Highly preferred polymers for use herein are polymers of the formula:

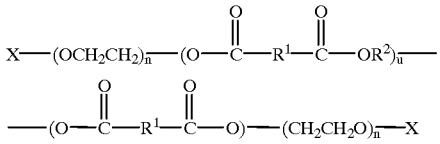

in which X can be any suitable capping group, with each X being selected from the group consisting of H, and alkyl or acyl groups containing from 1 to about 4 carbon atoms, preferably 1 to 2 carbon atoms, most preferably alkyl. Furthermore, the alkyl group may contain anionic, cationic or nonionic substituents such as sulphonate, sulphato, ammonium, hydroxy etc. groups. n is selected for water solubility and is a range of values which generally averages from about 10 to about 50, preferably from about 10 to about 25. There should be very little material, preferably less than about 10 mol %, more preferably less than 5 mol %, most preferably less than 1 mol %, in which u is greater than 5. Furthermore there should be at least 20 mol %, preferably at least 40 mol %, of material in which u ranges from 3 to 5.

The $R_1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4'-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

Preferably, the $R^1$ moieties consist entirely of (i.e., comprise 100%) 1,4-phenylene moieties, i.e. each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, or, preferably, 1,2-propylene moieties or mixtures thereof. Preferably, from about 75% to about 100%, more preferably from about 90% to about 100% of the $R^2$ moieties are 1,2-propylene moieties.

The value for n averages at least about 10, but a distribution of n values is present. The value of each n usually ranges from about 10 to about 50. Preferably, the value for each n averages in the range of from about 10 to about 25.

The most preferred polymers for use herein are polymers according to the formula:

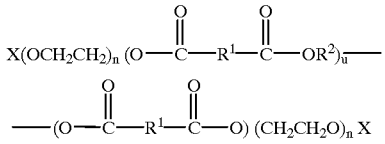

wherein X is methyl, n is 16, $R^1$ is 1,4-phenylene moiety, $R^2$ is 1,2-propylene moiety and u is essentially between 3 and 5.

Solvent:

As another optional component, the compositions of the invention can comprise a solvent in an effective amount so as to reach the desired viscosity.

Suitable solvents for use herein include low molecular weight alcohols such as $C_1$–$C_{10}$, preferably $C_1$–$C_4$ mono- and dihydric alcohols, preferably ethyl alcohol, isopropyl alcohol, propylene glycol and hexylene glycol.

The compositions herein typically comprise from 3% to 20% by weight of the total composition of an alcohol, or mixtures thereof, preferably 3% to 15%, most preferably 5% to 10%.

Preferably, the compositions herein are formulated as clear liquid compositions. By "clear" it is meant isotropic, stable and transparent. In order to achieve isotropic compositions, the use of solvents and hydrotropes is well known to those familiar with the art of dishwashing formulations. Those clear compositions are preferably packaged in transparent containers, which can typically be made out of plastic or glass.

In addition to the optional ingredients described hereinbefore, the compositions can contain other optional components suitable for use in liquid dishwashing compositions such as perfume, dye, opacifiers, enzymes, builders and chelants and pH buffering means so that the compositions herein generally have a pH of from 5 to 11, preferably 6.0 to 10.0, most preferably 7 to 9 measured at a 10% solution in water.

Method:

In the method aspect of this invention, soiled dishes are contacted with an effective amount, typically from about 0.5 ml. to about 20 ml. (per 25 dishes being treated), preferably from about 3 ml. to about 10 ml., of the detergent composition of the present invention. The actual amount of liquid detergent composition used will be based on the judgement of user, and will typically depend upon factors such as the particular product formulation of the composition, including the concentration of active ingredients in the composition, the number of soiled dishes to be cleaned, the degree of soiling on the dishes, and the like.

The particular product formulation, in turn, will depend upon a number of factors, such as the intended market (i.e., U.S., Europe, Japan, etc.) for the composition product.

In the method herein, the soiled dishes are preferably immersed into a water bath with or without a liquid dishwashing detergent as described herein. A dish implement, i.e. a device suitable for absorbing a liquid dishwashing detergent such as a sponge or a dishcloth, is placed directly onto or contacted with a separate quantity of undiluted liquid dishwashing composition as described herein for a period of time typically ranging from about 3 to about 10 seconds. The absorbing device, and consequently the undiluted liquid dishwashing composition, is then contacted individually to the surface of each of the soiled dishes to remove said soiling. The absorbing device is typically contacted with each dish surface for a period of time ranging from about 5 to about 30 seconds, although the actual time of application will be dependent upon factors such as the degree of soiling of the dish. The contacting of the absorbing device to the dish surface is preferably accompanied by concurrent scrubbing.

After all the dishes to be cleaned have been cleaned, the dish implement is preferably contacted, e.g. soaked with neat product and left to dry. There is little or no bacterial growth in the dish implements used according to the method herein even over extended usage, and contaminated dish implements (i.e. dish implements contaminated by previous uses with other compositions) also recover after one or several uses in a method according to the present invention.

Examples

The following compositions, which illustrate the invention, are made by mixing together the listed ingredients in the listed proportions.

| Example 1 | |
|---|---|
| Alcoholethoxylate (2.2) sulfate | 22 |
| Amine oxide | 3 |
| Nonionic | 7 |

-continued

| | |
|---|---|
| Glucose amide | 5 |
| Betaine | 2 |
| Mg++ | 0.5 |
| Ethanol | 7 |
| Sodium cumene sulfonate | 5 |
| Polypropylene glycol (2000) | 2.00 |
| Propylene glycol | 1.00 |
| Geraniol | 0.60 |
| Water | balance |
| pH (10% water) | 7.8 |

| Example 2 | |
|---|---|
| Alcoholethoxylate (2.2) sulfate | 22 |
| Amine oxide | 3 |
| Nonionic | 7 |
| Glucose amide | 5 |
| Betaine | 2 |
| Mg++ | 0.5 |
| Ethanol | 7 |
| Sodium toluene sulfonate | 5 |
| Polypropylene glycol (2000) | 2.00 |
| Propylene glycol | 1.00 |
| Geraniol | 0.25 |
| Thymol | 0.25 |
| Eugenol | 0.25 |
| Water | balance |
| pH (10% water) | 7.8 |

| Example 3 | |
|---|---|
| Alcoholethoxylate (3.0) sulfate | 19 |
| Alcyl polyglycoside | 2 |
| Nonionic | 13 |
| Amide | 2 DEA |
| Amine oxide | 6 |
| Mg++ | 0.02 |
| Ethanol | 3 |
| Sodium toluene sulfonate | 5 |
| Nacitrate | 3 |
| Geraniol | 0.60 |
| Water | balance |
| pH (10% water) | 6.4 |

| Example 4 | |
|---|---|
| Alcoholethoxylate (3.0) sulfate | 11 |
| Nonionic | 6 |
| Amide | 2 DEA |
| Amine oxide | 7 |
| Mg++ | 0.04 |
| Sodium toluene sulfonate | 8.00 |
| Geraniol | 0.30 |
| Thymol | 0.30 |
| Eugenol | 0.30 |
| Water | balance |
| pH (10% water) | 6.8 |

| Example 5 | |
|---|---|
| Alcoholethoxylate (0.6) sulfate | 26 |
| Amine oxide | 2 |
| Betaine | 2 |
| Glucose amide | 1.5 |
| Nonionic | 5 |
| Mg++ | 0.50 |
| Ethanol | 7 |
| Sodium cumene | 3 |

-continued

| | |
|---|---|
| sulfonate | |
| Geraniol | 0.60 |
| Water | balance |
| pH (10% water) | 7.8 |

Example 6

| | |
|---|---|
| Alcoholethoxylate (0.6) sulfate | 26 |
| Amine oxide | 2 |
| Betaine | 2 |
| Glucose amide | 1.5 |
| Nonionic | 5 |
| Mg++ | 0.50 |
| Ethanol | 7 |
| Sodium xylene sulfonate | 5 |
| Geraniol | 0.20 |
| Thymol | 0.20 |
| Eugenol | 0.20 |
| Water | balance |
| pH (10% water) | 7.8 |

Example 7

| | |
|---|---|
| Alcoholethoxylate (2.2) sulfate | 27 |
| Amine oxide | 6 |
| Nonionic | 4 |
| GS-base | 6 |
| Ethanol | 6 |
| Calcium xylene sulfonate | 4 |
| Geraniol | 0.60 |
| Triclosan | 0.25 |
| Water | balance |
| pH (10% water) | 7.80 |

Example 8

| | |
|---|---|
| Sodium parafinesulfate | 7 |
| Alcoholethoxylate (2.0) sulfate | 22 |
| Nonionic | 0.50 |
| Amide | 0.3 DEA |
| Betaine | 0.50 |
| Ethanol | 0.60 |
| Sodium toluene sulfonate | 5 |
| Water | balance |
| pH (10% water) | 6.30 |

Example 9

| | |
|---|---|
| Alcoholethoxylate (0.6) sulfate | 13 |
| Amine oxide | 0.8 |
| Betaine | 0.8 |
| Glucose Amide | 0.6 |
| Nonionic | 2 |
| Magnesium | 0.2 |
| SCS-Sodium | 2.5 |
| Cumen Sulfonate | |
| PEG 4000 | — |
| Geraniol | 0.6 |
| BHT | 0.02 |
| Ethanol | — |
| Viscosity (cps) | 280 |
| pH (10% water) | 7.0 |

Example 10

| | |
|---|---|
| Alcoholethoxylate (0.6) sulfate | 13 |
| Amine oxide | 0.8 |
| Betaine | 0.8 |
| Glucose Amide | 0.6 |
| Nonionic | 2 |

-continued

| | |
|---|---|
| Magnesium | 0.2 |
| SCS-Sodium | 2.0 |
| Cumen Sulfonate | |
| PEG 4000 | — |
| Geraniol | 2.0 |
| BHT | 0.02 |
| Ethanol | — |
| Viscosity (cps) | 380 |
| pH (10% water) | 7.8 |

Example 11

| | |
|---|---|
| Alcoholethoxylate (0.6) sulfate | 13 |
| Amine oxide | 0.8 |
| Betaine | 0.8 |
| Glucose Amide | 0.6 |
| Nonionic | 2 |
| Magnesium | 0.2 |
| SCS-Sodium | 6.0 |
| Cumen Sulfonate | |
| PEG 4000 | — |
| Geraniol | 0.6 |
| BHT | 0.02 |
| Ethanol | — |
| Viscosity (cps) | 5 |
| pH (10% water) | 7–7.8 |

What is claimed is:

1. A method for washing dishes which comprises applying to an absorbent implement an undiluted liquid dishwashing composition comprising a) from 10% to 60% by weight of the total composition of a surfactant, b) from 1% to 15% by weight of the total composition of a hydrotrope selected from the group consisting of salts of cumene sulfonate, toluene sulfonate, xylene sulfonate, benzene sulfonate and mixtures thereof; and c) from 0.1% to 3% by weight of the total composition of an unsaturated aliphatic terpene alcohol or derivative d) a phenolic compound of the formula

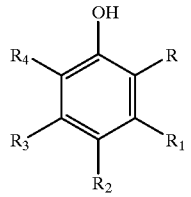

wherein R, $R_1$, $R_2$, $R_3$, and $R_4$ are independently selected from the group consisting of H, a linear or branched, saturated or unsaturated hydrocarbon chain having from 1 to 20 carbon atoms, an alkoxylated hydrocarbon chain Ra(A)n wherein Ra is a linear or branched, saturated or unsaturated hydrocarbon chain having from 1 to 20 carbon atoms, wherein A is selected from the group consisting of butoxy, propoxy, and ethoxy, and n is an integer of 1 to 4 or an aryl chain having from 1 to 20 carbon atoms, and mixtures thereof, applying said implement to dishes to be washed and thereafter soaking said implement in said undiluted and allowing said implement to dry, whereby microbial growth on said implement is retarded.

2. A method according to claim 1 wherein said composition comprises from 10% to 55% by weight of the total composition of said surfactant, from 1% to 10% by weight of the total composition of said hydrotrope, and from 0.2% to 2.5% by weight of the total composition of said unsaturated aliphatic terpene alcohol.

3. A method according to claim 1 wherein said unsaturated aliphatic terpene alcohol in the composition is geraniol.

4. A method according to claim 1, wherein said phenolic compound in said composition is selected from eugenol, thymol, and mixtures thereof.

5. A method according to claim 1 wherein said composition comprises from 0.1% to 4% by weight of the total composition of said phenolic compound.

* * * * *

UNITED STATES PATENT AND TRADEMARK OFFICE

CERTIFICATE OF CORRECTION

PATENT NO. : 6,152,152
DATED : November 28, 2000
INVENTOR(S) : M. J. Reynen et al.

It is certified that error appears in the above-identified patent and that said Letters Patent is hereby corrected as shown below:

Column 12, Line 65, "said implement in said undiluted and allowing said" should read --said implement in said undiluted composition and allowing said--

Signed and Sealed this

Eighth Day of May, 2001

*Attest:*

Nicholas P. Godici

NICHOLAS P. GODICI

*Attesting Officer*

*Acting Director of the United States Patent and Trademark Office*